US005512239A

United States Patent [19]

Fujiwara et al.

[11] Patent Number: 5,512,239

[45] Date of Patent: Apr. 30, 1996

[54] FERRITIC STAINLESS STEEL FOR HEAT EXCHANGER

[75] Inventors: Yoshito Fujiwara; Yutaka Kobayashi; Mituo Kimura; Masatoshi Iio; Tohsaku Takamura, all of Kanagawa, Japan

[73] Assignees: Tokyo Radiator Mfg. Co., Ltd, Tokyo; Nippon Yakin Kogyo Co. Ltd.; Nissan Motor Co., Ltd., both of Kanagawa, all of Japan

[21] Appl. No.: 423,377

[22] Filed: Apr. 18, 1995

[30] Foreign Application Priority Data

Apr. 22, 1994 [JP] Japan ..... 6-084811

[51] Int. Cl.[6] ..... C22C 38/26; C22C 38/28

[52] U.S. Cl. ..... 420/68; 420/69

[58] Field of Search ..... 420/68, 69; 148/325

[56] References Cited

U.S. PATENT DOCUMENTS

| | | | |
|---|---|---|---|
| 5,110,544 | 5/1992 | Sato et al. | 420/69 |
| 5,302,214 | 4/1994 | Uematsu et al. | 420/69 |

FOREIGN PATENT DOCUMENTS

| | | | |
|---|---|---|---|
| 54-72771 | 6/1979 | Japan | 420/69 |
| 55-110759 | 8/1980 | Japan | 420/68 |
| 4-63989 | 6/1992 | Japan . | |
| 4-63988 | 6/1992 | Japan . | |
| 4-63987 | 6/1992 | Japan . | |

OTHER PUBLICATIONS

English Translation of JP–U–4–63987.
English Translation of JP–U–4–63988.
English Translation of JP–U–4–63989.
"A Typical Various Heat–Exchanger" by Takuya Kotani, I.P.C. Co., Ltd.

*Primary Examiner*—Deborah Yee
*Attorney, Agent, or Firm*—Greenblum & Bernstein

[57] ABSTRACT

A ferritic stainless steel comprises C: not more than 0.025 wt %, Si: not more than 0.10 wt %, Mn: not more than 1.0 wt %, Cr: 17.0–25.0 wt %, Ni: not more than 0.50 wt %, Mo: 0.50–2.00 wt %, Al: not more than 0.025 wt %, N: not more than 0.025 wt %, at least one of Nb: 10(C wt %+ N wt %)–1.0 wt % and Ti: 10(C wt %+N wt %)–1.0 wt %, and the balance being substantially Fe and inevitable impurities and is effectively used in various heat exchangers.

1 Claim, 3 Drawing Sheets

FERRITIC STAINLESS STEEL FOR HEAT EXCHANGER

BACKGROUND OF THE INVENTION

1. Field of the Invention

This invention relates to a ferritic stainless steel for use in various types of heat exchangers.

2. Description of the Related Art

In general, the structural components of the heat exchanger, particularly heat transfer plate and the like, should be made as thin as possible for ensuring a large heat transfer efficiency. In the heat transfer plate or the like of the heat exchanger, however, as the thickness of the plate becomes thinner, the degradation of properties and service life is caused due to the occurrence of scale peeling accompanied with repetitive oxidation, so that it is important that the components have a high resistance to oxidation.

Under the above circumstances, stainless steels such as SUS304, SUS430 and the like are generally used as a material for the conventional heat exchanger.

The above SUS304 (austenitic stainless steel) presently used as the material for the heat exchanger is large in the reduction of the thickness accompanied with the scale peeling and is difficult to be used at a higher temperature.

In general, it is said that the larger the heat transferring amount per unit time or heat conductivity, the better the heat exchanger. On the other hand, this has such a problem that the difference in thermal expansion based on the difference in temperature among parts of the heat exchanger in operation is promoted to cause thermal stress. Particularly, when the thermal stress exceeds the tensile strength of the material, the cracking is created to damage an important air tightness as a performance of the heat exchanger. Considering this point, therefore, it is said that the thermal expansion coefficient is favorably small as a material for the heat exchanger.

As mentioned above, it is demanded that the essentially conflicting properties are excellent as the material for the heat exchanger. In this point, it is actually said that SUS304 does not sufficiently respond to this demand.

On the contrary, it is considered that SUS430 (ferritic stainless steel) is used as a material for the heat exchanger. However, the SUS430 steel hardly causes the scale peeling accompanied with the repetitive oxidation but is low in high-temperature strength, so that it is apt to be deformed by thermal stress when a high-temperature fluid is present in the heat exchanger and hence the heat exchanging efficiency undesirable lowers. Furthermore, the soldering operation (e.g. copper soldering) is frequently conducted in the manufacture of the heat exchanger. In this case, slow cooling is carried out after the heating to not lower than 1100° C., so that the material is sensitized to undesirably lower its corrosion resistance.

In order to prevent the degradation of the corrosion resistance due to the sensitization, therefore, there have hitherto been proposed ferritic stainless steels added with a stabilizing element such as SUS430LX and the like. However, SUS430LX tends to obstruct the solderability, so that it is required to improve upon this material because solderability has a very large influence upon heat exchanging efficiency.

If it is intended to heat exchange a combustion gas of a fluid containing sulfur, e.g. light oil as a fluid to be heat-exchanged, the corrosion resistance against sulfur-containing gas is naturally required, but the ferritic stainless steels such as SUS430 and SUS430LX are insufficient in such a corrosion resistance.

Furthermore, formability is mentioned as another important property of the material for the heat exchanger because the heat exchanger is generally manufactured by press forming. Therefore, material for the heat exchanger should be excellent in formability represented by a magnification of elongation, an Erichsen value or the like. This is also insufficient in the ferritic stainless steel such as SUS430 and the like.

SUMMARY OF THE INVENTION

It is, therefore, an object of the invention to solve the aforementioned drawbacks of conventional ferritic stainless steel and to provide a ferritic stainless steel having good oxidation resistance, corrosion resistance, solderability, formability and high-temperature strength as a material for the heat exchanger.

The inventors have made various studies in order to solve the above problems of the conventional techniques and found that when Nb or Ti as a stabilizing element and Mo are added to ferritic stainless steel as a material for the heat exchanger, it is effective to control the degradation of corrosion resistance due to the sensitization and the corrosion through sulfur and improve the high-temperature strength. And also, it has been found that it is effective to reduce Si and Al for preventing the degradation of the solderability and for improving the formability.

According to the invention, there is the provision of a ferritic stainless steel for heat exchangers: comprising not more than 0.025 wt % of C, not more than 0.10 wt % of Si, not more than 1.0 wt % of Mn, 17.0–25.0 wt % of Cr, not more than 0.50 wt % of Ni, 0.50–2.00 wt % of Mo, not more than 0.025 wt % of Al, not more than 0.025 wt % of N, at least one of Nb: 10(C wt %+N wt %)–1.0 wt % and Ti: 10(C wt %+N wt %)–1.0 wt %, and the balance being substantially Fe and inevitable impurities.

In a preferred embodiment of the invention, the ferritic stainless steel for heat exchangers comprises not more than 0.015 wt % of C, not more than 0.05 wt % of Si, not more than 1.0 wt % of Mn, 18.0–20.0 wt % of Cr, not more than 0.50 wt % of Ni, 0.70–1.00 wt % of Mo, not more than 0.020 wt % of Al, not more than 0.015 wt % of N, at least one of Nb: 15(C wt %+N wt %)–0.7 wt % and Ti: 15(C wt %+N wt %)–0.7 wt %, and the balance being substantially Fe and inevitable impurities.

DESCRIPTION OF THE PREFERRED EMBODIMENTS

Figure 1:
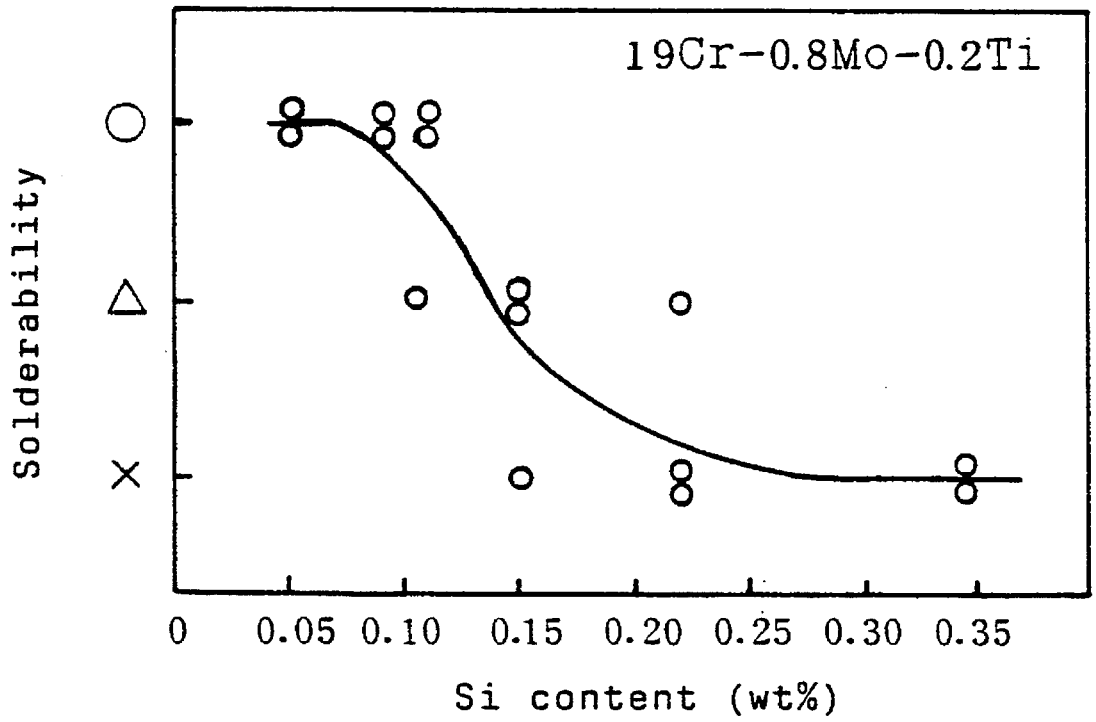
FIG. 1 is a graph showing a relation between Si content and solderability in 19Cr-0.8Mo-0.2Ti steel.

The inventors have examined an influence of constitutional elements upon oxidation resistance, corrosion resistance and high-temperature strength under high temperature environments of the stainless steel for the heat exchanger and solderability and press formability in the manufacture of the heat exchanger in detail. As a result, it has been found that all of the above properties are satisfied in the ferritic stainless steel by adding given amounts of Nb, Ti and Mo and reducing amounts of Si and Al as far as possible as previously mentioned.

The fundamental thought of the invention will be described below.

As the material for the heat exchanger according to the invention, it is said that ferritic stainless steels are useful rather than austenitic stainless steels considering the high thermal conductivity, low thermal expansion coefficient and the like required in this material.

When Nb and Ti are added to the ferritic stainless steel, they are effective to suppress the intergranular corrosion due to the sensitization generated at a high-temperature treatment in the soldering. Particularly, when the amount of Nb and Ti added becomes excessive than that required for the fixation of C and N, it is very effective to improve the strength at a high temperature by solid solution strengthening.

When Mo is added to the ferritic stainless steel, it is very effective to improve the high-temperature strength. This is due to the same fact as in the addition of Nb and Ti. Further, the addition of Mo forms a strong oxide film in the use of heat exchanger together with Cr to improve the corrosion resistance.

When Si and Al are added to the ferritic stainless steel, if the amount of these elements added is decreased, it effectively acts to improve the solderability. The inventors have considered the followings on the improvement of the solderability.

In general, the soldering is carried out by a high temperature heat treatment under vacuum. In this case, the strong oxide film generated on a surface is mentioned as a factor of obstructing the solderability or a flowability of a solder. In this point, Nb, Ti, Si and Al are strong in the affinity with oxygen as compared with Cr, so that the element such as Nb or the like is oxidized even under vacuum conducting no oxidation of Cr to form the strong oxide film. However, when the addition of Nb and Ti is necessary to be carried out for the prevention of sensitization, it is required to decrease the amount of Si and Al as a countermeasure. It is considered that when the amount of Si and Al is decreased, the factor of forming the oxide film is reduced to improve the solderability. Furthermore, the decrease of Si and Al effectively acts to improve the formability. Because it is considered that the softening is generated by the decrease of Si and Al promoting the solution strengthening.

The reason on the limitation of constitutional elements based on the basic alloying design idea according to the invention will be described below.

C: not more than 0.025 wt %

N: not more than 0.025 wt %

C and N considerably promote solution strengthening in the ferritic stainless steel and considerably degrade the toughness in the steel sheet. These elements form carbonitride together with Cr in steel to degrade the corrosion resistance, so that the amounts thereof is made as small as possible. However, when the amounts are excessively decreased, the difficulties are caused from viewpoint of productivity and economical reasons. Therefore, the amount of each of C and N is restricted to not more than 0.025 wt %. Preferably, the amount of each of C and N is not more than 0.015 wt %.

Si: not more than 0.10 wt %

Si is an element playing an important role in the invention. In the ferritic stainless steel according to the invention, when the amount of Si is decreased, the formation of oxide film as a surface layer is suppressed at the heat treatment for the soldering under vacuum to provide an effect of relatively lowering damage of solderability or solder flowability due to the formation of oxide film through the addition of Nb, Ti and the like as compared with steels containing Si amount of usual level. At the same time, the softening is attained by decreasing the Si amount for the promotion of the solution strengthening to enhance the elongation of the material and Erichsen value, whereby the formability is improved.

FIG. 1 shows an influence of Si amount upon the Cu solderability in the heat treatment of 19Cr-0.8Mo-0.2Ti steel under vacuum.

As seen from FIG. 1, when the Si amount is not more than 0.10 wt %, the solderability is considerably improved. Since Ti and Si are active elements and are strong in the affinity with oxygen, they are apt to form an oxide film even under vacuum, but it is considered that when the Si amount is decreased as far as possible, there is only formed an oxide film capable of sufficiently conducting the soldering.

Moreover, the experiment of the illustrated embodiment is conducted by placing Cu foil and ring-shaped jig on the surface of the test specimen in this order, subjecting them to a vacuum treatment at 1130° C. to fuse Cu and then soldering the ring onto the test specimen. The evaluation of the solderability is judged by the presence or absence of soldering defects in the circumference of the ring.

Figure 2:
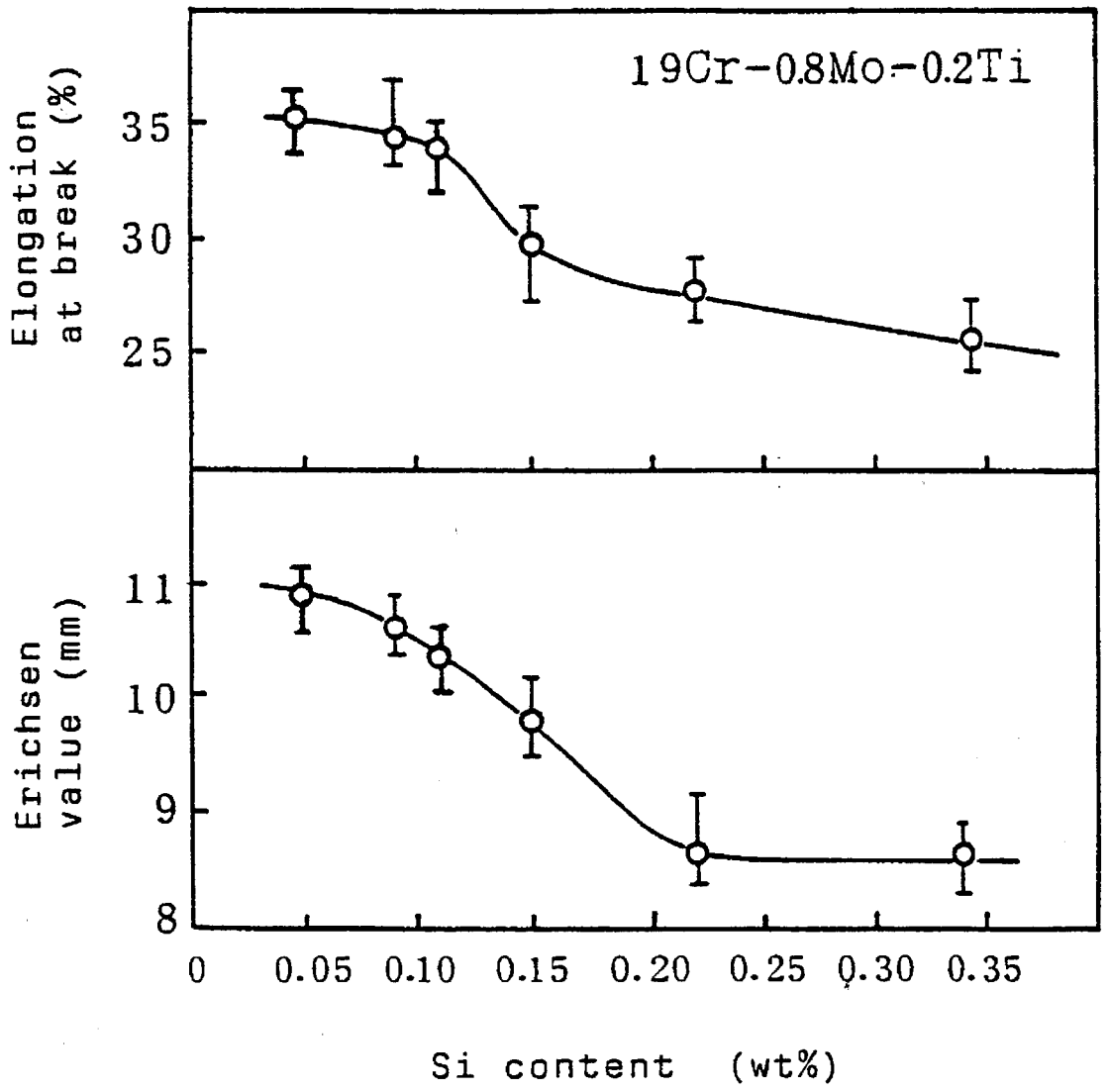
FIG. 2 is a graph showing a relation of Si content to elongation at break and Erichsen value in 19Cr-0.8Mo-0.2Ti steel.

On the other hand, FIG. 2 shows an influence of the Si amount upon the elongation and Erichsen value through tensile test of the same kind of the steel as mentioned above (thickness: 1 mm). From this experiment, it is obvious that when the Si amount is not more than 0.10 wt %, the elongation and Erichsen value considerably increase. Therefore, the Si amount is favorable to be decreased as far as possible from a viewpoint of the press formability.

From the above reasons, the Si amount according to the invention is restricted to not more than 0.10 wt %, preferably not more than 0.05 wt %.

Mn: not more than 1.0 wt %

Mn is incorporated from the starting material in the production stage or in the deoxidation to form a sulfide in steel, which considerably degrades the corrosion resistance and the formability. Therefore, the Mn amount is preferably low. However, it is restricted to not more than 1.0 wt % considering the productivity.

Cr: 17.0–25.0 wt %

Cr is an important element serving to improve the corrosion resistance and oxidation resistance. According to the inventors' studies, it has been confirmed that when the Cr amount is less than 17 wt %, the corrosion resistance and oxidation resistance are insufficient under the heat exchanger using environment. In order to sufficiently develop the effect of Cr, it is required to add Cr at an amount of not less than 17 wt %. However, when it exceeds 25 wt %, the effect is saturated and the productivity is considerably degraded, so that the Cr amount is restricted to a range of 17.0–25.0 wt %, preferably 18.0–20.0 wt %.

Ni: not more than 0.50 wt %

Ni is incorporated from the starting material in the production stage, which raises the strength through solution strengthening but degrades the formability. Considering this and the productivity, the amount is restricted to not more than 0.50 wt %.

Mo: 0.50–2.00 wt %

Mo is an element playing a great role in the invention. According to the inventors' studies, it has been confirmed that the addition of Mo is very effective to control the wet corrosion against erosion under the heat exchanger using environment in which combustion gas containing sulfur is condensed to produce sulfuric acid. Furthermore, the addition of Mo is effective to control the degradation of the corrosion resistance through the composite effect with Cr even in the heat treatment under vacuum for the soldering at the production of the heat exchanger. Moreover, it has been confirmed that Mo is effective to improve the high-temperature strength.

Table 1 shows an influence of Mo upon the corrosion resistance when the test specimen of 19Cr-0.4Nb steel treated at 1130° C. under vacuum is immersed in sulfuric acid. From these test results, it is found that when the Mo amount is less than 0.50 wt %, the general corrosion is created irrespectively of the concentration of sulfuric acid, while the addition of Mo in an amount of not less than 0.50 wt % can completely control the occurrence of the general corrosion. Therefore, in order to improve the corrosion resistance under the heat exchanger using environment, particularly the resistance to general corrosion due to sulfur content, it is necessary to add not less than 0.50 wt % of Mo. On the other hand, the strength rises to degrade the forming workability at the addition of more than 2.00 wt % and also there may be caused problems such as degradation of toughness and the like. From the above reasons, the Mo amount is restricted to a range of 0.50–2.00 wt %, preferably 0.70–1.00 wt %.

TABLE 1

| Concentration | Mo amount (19 Cr-0.4 Nb steel) | | | | | |
|---|---|---|---|---|---|---|
| of sulfuric acid | 0 | 0.27 | 0.41 | 0.58 | 0.80 | 1.35 |
| 5% | x x | ○ ○ | ○ ○ | ○ ○ | ○ ○ | ○ ○ |
| 10% | x x | ○x | ○ ○ | ○ ○ | ○ ○ | ○ ○ |
| 20% | x x | x x | ○x | ○ ○ | ○ ○ | ○ ○ |

Al: not more than 0.025 wt %

Al is an element playing a great role in the invention. That is, Al is added as a deoxidizer and remains in steel. According to the inventors' studies, it has been found that since Al is an active element and is strong in the affinity with oxygen, when the remaining amount is decreased as far as possible, the formation of surface oxide film is controlled at the heat treatment for the soldering under vacuum to improve the solderability or the flowability of the solder.

Figure 3:
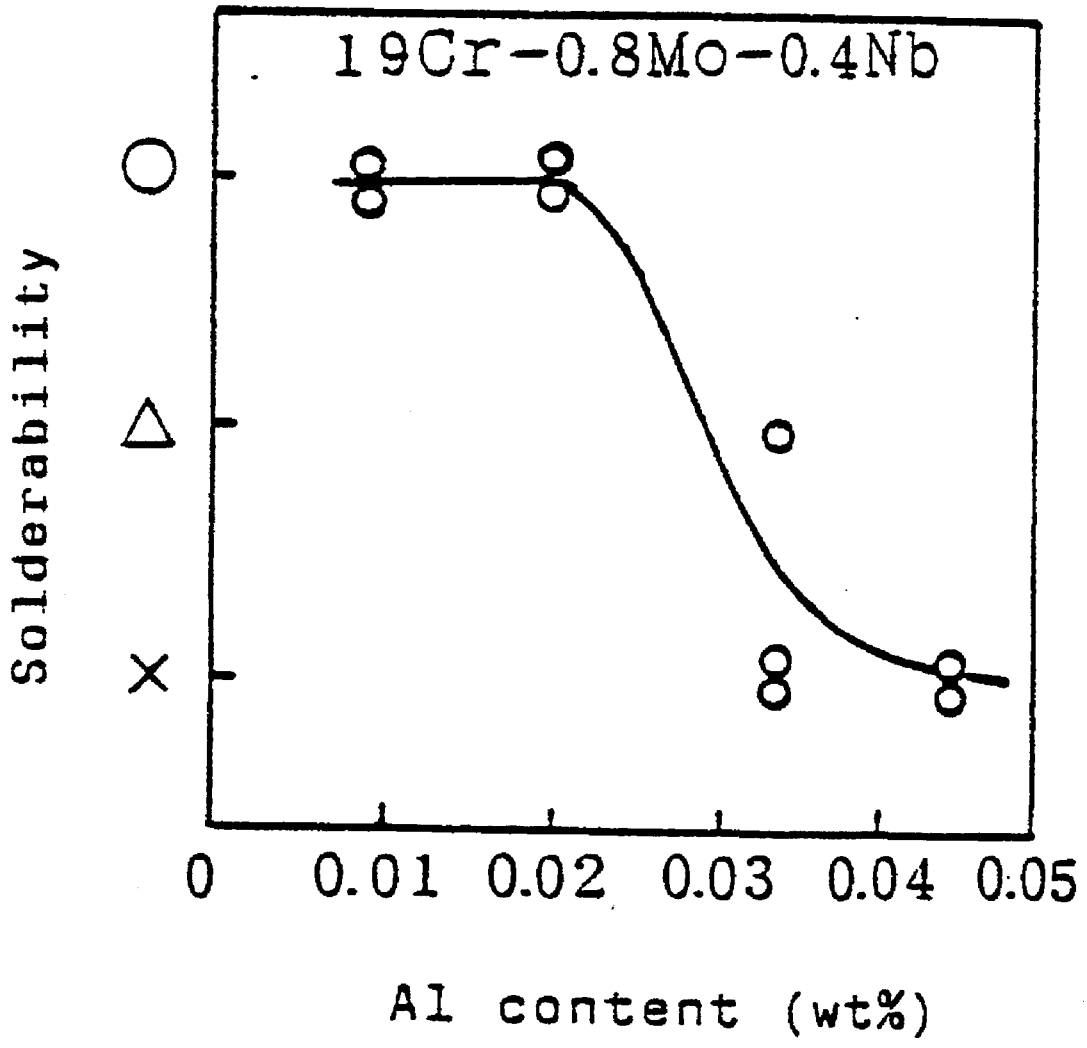
FIG. 3 is a graph showing a relation between Al content and solderability in 19Cr-0.8Mo-0.4Nb steel.

FIG. 3 shows an influence of Al amount upon Cu solderablity in the heat treatment under vacuum of 19Cr-0.8Mo-0.4Nb steel. As seen from FIG. 3, when the Al amount exceeds 0.025 wt %, the ratio of poor soldering increases and the solderability lowers. Since Al is an active element and is strong in the affinity with oxygen and easily forms an oxide film even under vacuum likewise the aforementioned effect by the decreasing the Si amount, it is considered that only the oxide film enough to conduct the soldering is formed by decreasing the Al amount as far as possible. From this reason, according to the invention, the Al amount is restricted to not more than 0.025 wt %, preferably not more than 0.020 wt %.

Nb: 10(C wt %+N wt %)–1.0 wt %

Ti: 10(C wt %+N wt %)–1.0 wt %

Nb and Ti are very important elements in the invention. In general, the soldering is carried out by heating above 1100° C. and then slowly cooling, so that C and N are sensitized by bonding to Cr included in steel to cause grain boundary corrosion if Nb and Ti are not added. In this connection, the addition of Nb and Ti have an effect of stabilizing C and N without damaging. In order to sufficiently develop this effect, it is required to add Nb or Ti in an amount corresponding to not less than 10 times of (C+N) amount. On the other hand, the inventors have confirmed to improve the strength of the material at a high temperature by adding Nb and Ti. However, the addition of Nb or Ti in a great amount considerably increase the strength of the material and degraded the forming workability and the solderability. Such an action becomes conspicuous at a region in which the addition amount of each of Ti and Nb exceeds 1.0 wt %. From these reasons, the amount of each of Nb and Ti is restricted to a range of 10(C+N) wt %–1.0 wt %, preferably 15(C+N) wt %–0.7 wt %.

Moreover, P and S are inevitable impurities degrading the corrosion resistance, so that the amount thereof is desirably made lower without damaging for economical reasons.

The following examples are given in illustration of the invention and are not intended as limitations thereof. Table 2 shows chemical compositions of invention steels and comparative steels. Each test specimen of 1.0 mm in thickness is experimentarily prepared by melting 10 kg of each material in air, forging, cold rolling and then pickling and annealing. The resulting test specimen is evaluated by the following test:

(1) The evaluation of the solderability in the manufacture of the heat exchanger is carried out by placing a Cu foil and a ring of SUS304 steel on the surface of the test specimen in this order, heating up to 1130° C. under vacuum and then slowly cooling to solder the ring and the test specimen with molten Cu. The solderability is evaluated by observing the presence or absence of poor soldering around the ring.

(2) The evaluation of the oxidation resistance under high temperature environment is carried out by repetitive oxidation test (33 cycles) in air at 900° C. for 3 hours considering the service conditions. The oxidation resistance is evaluated by the measurement of increasing or decreasing weight.

(3) The evaluation of the corrosion resistance against sulfuric acid condensed in the heat exchanger with the use of combustion gas containing sulfur is carried out by observing the presence or absence of general corrosion through the immersion test in an aqueous solution of 5, 10 or 20 wt % of sulfuric acid at 80° C. Moreover, the test specimen is used after being previously heated to 1130° C. in a vacuum furnace.

(4) The evaluation of the shapeability is carried out by measuring an elongation value through tensile test at room temperature (use of JIS13B test specimen) and an expansion height through an Erichsen test.

(5) The strength at high temperature is evaluated by a tensile strength through a high-temperature tensile test at 700° C.

The test results are shown in Table 3.

TABLE 2

| No. | C | Si | Mn | Ni | Cr | Mo | Nb | Ti | Al | N | Remarks |
|---|---|---|---|---|---|---|---|---|---|---|---|
| Invention Steel | | | | | | | | | | | |
| 1 | 0.009 | 0.04 | 0.21 | 0.25 | 17.27 | 1.16 | — | 0.29 | 0.020 | 0.009 | |
| 2 | 0.013 | 0.03 | 0.16 | 0.14 | 18.97 | 0.58 | 0.41 | — | 0.020 | 0.009 | |
| 3 | 0.011 | 0.05 | 0.21 | 0.18 | 19.03 | 0.80 | 0.37 | — | 0.009 | 0.009 | |
| 4 | 0.008 | 0.06 | 0.23 | 0.39 | 19.03 | 0.82 | — | 0.21 | 0.011 | 0.010 | |

TABLE 2-continued

| No. | C | Si | Mn | Ni | Cr | Mo | Nb | Ti | Al | N | Remarks |
|---|---|---|---|---|---|---|---|---|---|---|---|
| 5 | 0.007 | 0.09 | 0.19 | 0.34 | 19.03 | 0.79 | — | 0.20 | 0.023 | 0.006 | |
| 6 | 0.017 | 0.04 | 0.35 | 0.31 | 22.01 | 1.03 | 0.65 | — | 0.013 | 0.021 | |
| 7 | 0.017 | 0.04 | 0.35 | 0.31 | 18.17 | 1.92 | — | 0.57 | 0.018 | 0.016 | |
| 8 | 0.013 | 0.07 | 0.24 | 0.41 | 23.89 | 0.97 | 0.37 | 0.26 | 0.020 | 0.012 | |
| Conventional Steel | | | | | | | | | | | |
| 9 | 0.039 | 0.45 | 1.02 | 8.13 | 18.13 | — | — | — | 0.011 | 0.029 | SUS304 |
| 10 | 0.021 | 0.37 | 0.46 | 0.22 | 16.07 | — | — | — | 0.009 | 0.035 | SUS430 |
| 11 | 0.013 | 0.29 | 0.35 | 0.19 | 16.12 | — | 0.38 | — | 0.023 | 0.025 | SUS430LX |
| Comparative Steel | | | | | | | | | | | |
| 12 | 0.011 | 0.04 | 0.19 | 0.18 | 18.93 | 0.41 | 0.35 | — | 0.016 | 0.012 | |
| 13 | 0.010 | 0.15 | 0.25 | 1.22 | 18.99 | 0.82 | — | 0.20 | 0.017 | 0.012 | |
| 14 | 0.017 | 0.08 | 0.19 | 0.29 | 19.07 | 0.78 | 0.39 | — | 0.034 | 0.013 | |

TABLE 3

| No. | Solder-ability | Oxidation increasing or decreasing amount at repetitive oxidation test ($mg/cm^2$) (900° C. × 3 hours, 33 cycles) | Presence or absence of corrosion at immersion test in sulfuric asid (80° C., 4 hours) 5% | 10% | 20% | Elonga-tion at break (%) | Erichsen value (mm) | Tensile strength at 700° C. ($N/mm^2$) |
|---|---|---|---|---|---|---|---|---|
| Invention Steel | | | | | | | | |
| 1 | ○ ○ | 1.34 | ○ ○ | ○ ○ | ○ ○ | 34.2 | 11.0 | 102 |
| 2 | ○ ○ | 0.85 | ○ ○ | ○ ○ | ○ ○ | 33.6 | 10.7 | 152 |
| 3 | ○ ○ | 0.79 | ○ ○ | ○ ○ | ○ ○ | 32.9 | 10.6 | 166 |
| 4 | ○ ○ | 0.81 | ○ ○ | ○ ○ | ○ ○ | 34.7 | 10.9 | 92 |
| 5 | ○ ○ | 0.78 | ○ ○ | ○ ○ | ○ ○ | 34.3 | 10.5 | 101 |
| 6 | ○ ○ | 0.42 | ○ ○ | ○ ○ | ○ ○ | 31.1 | 10.1 | 185 |
| 7 | ○ ○ | 0.63 | ○ ○ | ○ ○ | ○ ○ | 32.5 | 10.4 | 161 |
| 8 | ○ ○ | 0.21 | ○ ○ | ○ ○ | ○ ○ | 30.8 | 9.7 | 193 |
| Conventional Steel | | | | | | | | |
| 9 | ○ ○ | −18.27 (scale peeling) | ○ ○ | ○ ○ | ○ ○ | 55.8 | 12.3 | 294 |
| 10 | ○ ○ | 26.12 (extra ordinary oxidation | x x | x x | x x | 27.3 | 8.7 | 66 |
| 11 | x x Δ | 3.42 | x x | x x | x x | 30.1 | 9.6 | 87 |
| Comparative Steel | | | | | | | | |
| 12 | ○ ○ | 0.90 | ○ ○ | ○ ○ | ○ ○ | 32.8 | 10.7 | 148 |
| 13 | x Δ Δ | 0.83 | ○ ○ | ○ ○ | ○ ○ | 29.7 | 9.8 | 169 |
| 14 | x x Δ | 0.77 | ○ ○ | ○ ○ | ○ ○ | 30.3 | 10.1 | 110 |

1)
○: no poor soldering
Δ: partly poor soldering
x: considerably poor soldering
2)
○: no corrosion
x: occurrence of general corrosion As seen from the test results, the invention steels in which the proper amount of Mo is added and the stabilization is carried out with Nb or Ti and the amount of Si and Al is decreased as far as possible are excellent in the corrosion resistance and oxidation resistance under the heat exchanger using environment, high in the high-temperature strength and good in the solderability and shapeability as compared with the conventional SUS304 and SUS430 steels and comparative steels having less Mo amount and high Si and Al amounts used in the heat exchanger. Particularly, the invention steels develop sufficient corrosion resistance and oxidation resistance in the heat exchangers used under various severe conditions and hardly deform even at high temperatures and good in the productivity for the heat exchanger.

As mentioned above, according to the invention, the corrosion resistance and oxidation resistance under environment using the heat exchanger are excellent, and the high-temperature strength is high, and the solderability and shapeability are good as compared with the conventional materials such as SUS304, SUS430 and the like used in the heat exchanger, so that the materials for the heat exchanger having excellent properties can be provided at a relatively cheap cost.

What is claimed is:

1. A ferritic stainless steel for heat exchangers consisting essentially of:

not more than 0.015 wt % of C;

not more than 0.05 wt % of Si;

not more than 1.0 wt % of Mn;

18.0–20.0 wt % of Cr;

not more than 0.50 wt % Ni;

0.70–1.00 wt % of Mo;

not more than 0.020 wt % of Al;

not more than 0.015 wt % of N;

at least one of Nb in an amount of 15(C wt %+N wt %)–0.7 wt %, and Ti in an amount of 15(C wt %+N wt %)–0.7 wt %; and a balance of substantially Fe and inevitable impurities.

* * * * *

UNITED STATES PATENT AND TRADEMARK OFFICE

CERTIFICATE OF CORRECTION

PATENT NO. : 5,512,239

DATED : April 30, 1996

INVENTOR(S) : Y. FUJIWARA et al.

It is certified that error appears in the above-indentified patent and that said Letters Patent is hereby corrected as shown below:

Title page, item [73], "Assignees", lines 1-4, change "Tokyo Radiator Mfg. Co., Ltd, Tokyo; Nippon Yakin Kogyo Co. Ltd.; Nissan Motor Co., Ltd., both of Kanagawa, all of Japan" to ---Nippon Yakin Kogyo Co., Ltd., Tokyo; Tokyo Radiator Mfg. Co., Ltd.; Nissan Motor Co., Ltd., both of Kanagawa, all of Japan---.

Signed and Sealed this

Eighteenth Day of February, 1997

*Attest:*

*Attesting Officer*

BRUCE LEHMAN

*Commissioner of Patents and Trademarks*